US006640522B2

(12) United States Patent
Antoniazzi et al.

(10) Patent No.: US 6,640,522 B2
(45) Date of Patent: Nov. 4, 2003

(54) METHOD AND MACHINE FOR PACKING REAMS OF SHEETS

(75) Inventors: Luca Antoniazzi, Bologna (IT); Andrea Cinotti, Bologna (IT)

(73) Assignee: Innopack SRL, Calderara di Reno (IT)

( * ) Notice: Subject to any disclaimer, the term of this patent is extended or adjusted under 35 U.S.C. 154(b) by 0 days.

(21) Appl. No.: 10/057,382

(22) Filed: Jan. 25, 2002

(65) Prior Publication Data

US 2002/0139090 A1 Oct. 3, 2002

(30) Foreign Application Priority Data

Jan. 26, 2001 (IT) ..... TO2001A0075

(51) Int. Cl.[7] ..... B65B 11/04

(52) U.S. Cl. ..... 53/466; 53/223; 53/230; 53/232; 53/234

(58) Field of Search ..... 533/223, 228, 533/230, 232, 233, 234, 466

(56) References Cited

U.S. PATENT DOCUMENTS

| | | | | | |
|---|---|---|---|---|---|
| 1,458,977 | A | * | 6/1923 | Escobales | 229/87.13 |
| 2,182,113 | A | * | 12/1939 | Bronander | 53/463 |
| 2,192,683 | A | * | 3/1940 | Bronander | 53/223 |
| 2,196,910 | A | * | 4/1940 | Delamere | 53/223 |
| 2,609,646 | A | * | 9/1952 | Total | 53/230 |
| 2,620,964 | A | * | 12/1952 | Rose | 229/87.18 |
| 2,860,466 | A | * | 11/1958 | Ingram | 53/223 |
| 3,996,728 | A | | 12/1976 | Gentili | |
| 4,517,785 | A | | 5/1985 | Masuda | |
| 4,648,236 | A | * | 3/1987 | Knecht | 53/234 |
| 4,897,983 | A | * | 2/1990 | Hogenkamp et al. | 53/461 |
| 4,909,019 | A | * | 3/1990 | Delacretaz et al. | 53/463 |
| 5,701,725 | A | * | 12/1997 | Neri et al. | 53/466 |
| 5,839,253 | A | * | 11/1998 | Draghetti | 53/234 |
| 5,996,318 | A | * | 12/1999 | Draghetti | 53/466 |

FOREIGN PATENT DOCUMENTS

| | | |
|---|---|---|
| EP | 515320 | 11/1992 |

* cited by examiner

*Primary Examiner*—Stephen F. Gerrity
*Assistant Examiner*—Hemant M. Desai
(74) *Attorney, Agent, or Firm*—Michael Best & Friedrich LLC

(57) ABSTRACT

A method of packing rearms of sheets, wherein each ream is defined by sheets stacked to form a rectangular-base prism of a given height, and has two base faces defined by respective end sheets in the ream, two lateral faces perpendicular to the base faces, and two end faces. The method providing for feeding the ream along a given path in a feed direction parallel to the base faces. Placing a sheet of packing material along the path of the ream and perpendicular to the feed direction, and conveying the ream and the sheet of packing material in the feed direction through a folding spindle to fold the sheet of packing material into a U about the ream.

21 Claims, 5 Drawing Sheets

1
4
5
9
10
11
12
13
14
15
16
17
18
19
20
27
29
30
31
32
33
34
35
36
38
39
45
46
47
52
53
54
55
56
57
58
59
60
P
D1

METHOD AND MACHINE FOR PACKING REAMS OF SHEETS

The present invention relates to a method of packing reams of sheets.

More specifically, the present invention relates to a method of packing reams of sheets of paper, to which the following description refers purely by way of example.

BACKGROUND OF THE INVENTION

A ream of sheets of paper comprises rectangular sheets of paper stacked and aligned to form a rectangular-base prism having two base faces defined by two opposite end sheets in the ream; two opposite lateral faces perpendicular to the base faces, i.e. two faces adjacent to the major sides of the base faces; and two opposite end faces perpendicular to the base faces and lateral faces, i.e. two faces adjacent to the minor sides of the base faces.

Known methods of packing reams of sheets of paper are normally based on the principle of folding a sheet of packing material about a ream to form a tubular package enclosing the ream and having two opposite projecting portions projecting from the end faces; and folding the projecting portions on to the respective end faces.

More specifically, one known method of packing reams of sheets of paper comprises feeding a ream along a given path in a first feed direction parallel to the base faces; arresting the ream of sheets of paper to feed it in a second direction perpendicular to the base faces; placing a sheet of packing material perpendicular to the second direction, i.e. parallel to the base faces; and folding the sheet of packing material into a U about the ream by means of a folding spindle as the ream is fed in the second direction. Once the sheet of packing material is folded into a U, the ream is arrested to form the tubular package by means of movable folding devices.

The above method has the drawback of subjecting the reams without the sheets of packing material to severe acceleration when switching from the first to the second direction. Rapid acceleration in different directions tends to reduce friction between the sheets in the ream and to disarrange the stack, also in view of the fact that the ream is accelerated without the sheet of packing material, which, when partly folded, contributes towards keeping the sheets in the ream aligned. As a result, acceleration of the ream must be kept as low as possible, thus greatly reducing the output of the packing machine implementing the above method.

SUMMARY OF THE INVENTION

It is an object of the present invention to provide a method of packing reams of sheets, designed to eliminate the drawbacks of the known state of the art, and which, in particular, provides for obtaining high-output packing machines with no risk of disarranging the sheets in each ream.

According to the present invention, there is provided a method of packing reams of sheets, wherein each ream is defined by sheets stacked to form a rectangular-base prism of a given height, and comprises two base faces defined by respective end sheets in said ream, two lateral faces perpendicular to the base faces, and two end faces; the method comprising feeding said ream along a given path by means of a feed unit, placing a sheet of packing material along the path of the ream by means of a supply unit for supplying sheets of packing material, and conveying the ream and the sheet of packing material through a folding spindle to form a U-shaped fold; the method being characterized by pushing said ream in a feed direction parallel to said base faces, and placing said sheet of packing material crosswise to said feed direction.

The present invention also relates to a machine for packing reams of sheets.

According to the present invention, there is provided a machine for packing reams of sheets, wherein each ream is defined by sheets stacked to form a rectangular-base prism of a given height, and comprises two base faces defined by respective end sheets in said ream, two lateral faces perpendicular to the base faces, and two end faces; the machine comprising a feed unit for feeding said ream along a given path, a supply unit for supplying sheets of packing material and for placing a sheet of packing material along the path of the ream, and a folding spindle located along the path to fold the sheet of packing material into a U about said ream; the machine being characterized in that said feed unit comprises a first conveyor for pushing said ream, at said folding spindle, in a feed direction parallel to said base faces; and said supply unit comprising a conveying device for keeping said sheet of packing material crosswise to the feed direction at said folding spindle.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
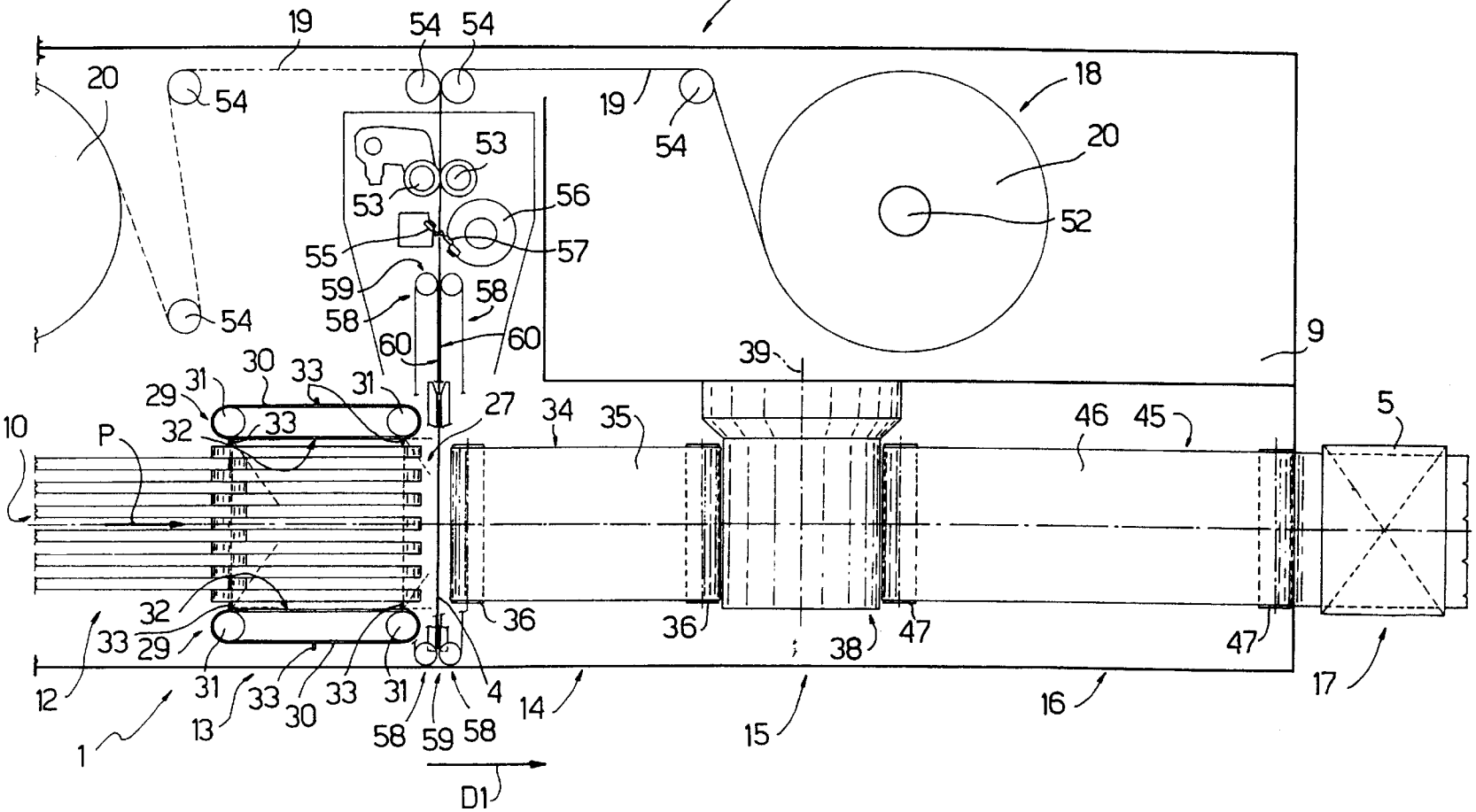
FIG. 1 shows a plan view, with parts removed for clarity, of a machine for packing reams of sheets and implementing the method according to the present invention.
Figure 13:
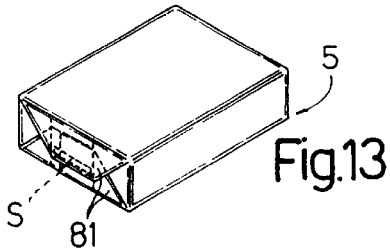

Number 1 in FIG. 1 indicates as a whole a machine for packing reams 2 of sheets 3 of paper in respective sheets 4 of packing material to form packs 5, one of which is shown in FIG. 13.

Figure 6:
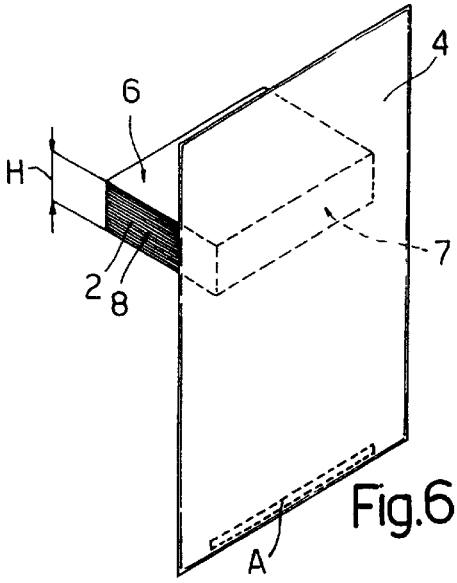
FIGS. 6 to 13 show views in perspective of a ream of sheets and a respective sheet of packing material at different steps in the method according to the present invention.

With reference to FIG. 6, each ream 2 comprises a number of sheets 3 stacked and aligned to form a ream 2 in the form of a rectangular-base prism of height H. Ream 2 comprises two opposite parallel base faces 6, each defined by an end sheet 3 in ream 2, and only one of which is shown in FIG. 6; two parallel lateral faces 7 facing each other and perpendicular to base faces 6; and two parallel end faces 8 facing each other and perpendicular to base faces 6. Only one of lateral faces 7 and one of end faces 8 are shown in FIG. 6. The rectangular-prism shape of ream 2 depends on the alignment of sheets 3, which contact one another and are kept aligned by the friction between adjacent sheets 3 in ream 2 when the forces acting on ream 2 are within given values.

With reference to FIG. 1, machine 1 comprises a frame 9, which supports a feed unit 10 for feeding reams 2 and packs 5 along a path P, a supply unit 11 for supplying sheets 4 of packing material to a packing station located along path P, and folding members indicated and described in detail later on.

Feed unit 10 comprises a series of conveyors 12, 13, 14, 15, 16, 17: conveyor 12 provides for supplying reams 2; conveyor 17 for removing packs 5; and conveyors 13, 14, 15 and 16 for feeding ream 2 and respective sheet 4 of packing material past said folding members. Conveyors 12, 13, 14, 15, 16, 17 are adjacent to one another and aligned in a horizontal direction D1 parallel to path P.

Supply unit 11 comprises an unwinding device 18 for unwinding two strips 19 off respective reels 20; a cut-off device 21 for cutting sheets 4 off one of strips 19; and a conveying device 22 for conveying sheets 4 and placing each sheet 4 in a given position with respect to feed unit 10 and a respective ream 2.

Figure 2:
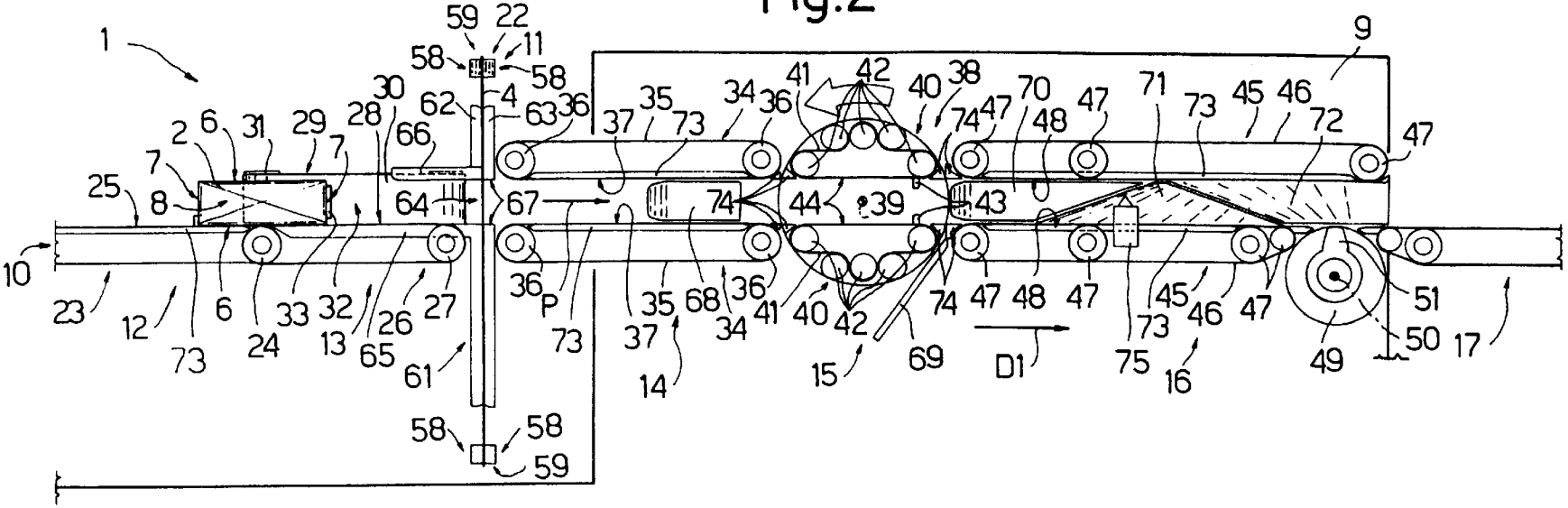
FIG. 2 shows a schematic side view, with parts removed for clarity, of the FIG. 1 machine in the course of a first step in the method according to the present invention.

With reference to FIGS. 1 and 2, conveyor 12 comprises a conveyor 23 with belts looped about pulleys 24 (only one shown in FIGS. 1 and 2), and has a work branch 25 on which a base face 6 of each ream 2 rests. Conveyor 13 comprises a conveyor 26 with belts looped about pulley 24 and a pulley 27 to define a work branch 28 coplanar with work branch 25. Conveyor 13 also comprises two belt conveyors 29 located on opposite sides of conveyor 26, and each of which comprises a belt 30 looped about two pulleys 31 rotating about vertical axes, and has a work branch 32 perpendicular to work branch 28. Belts 30 of belt conveyors 29 are spaced apart so as to contact the end faces 8 of each ream 2 along respective work branches 32, and comprise projections 33 which, in use, contact lateral faces 7 at the edges formed by lateral faces 7 and end faces 8. Conveyor 14 is located downstream from conveyor 13 and conveying device 22—for conveying sheets 4 of packing material and which extends partly between conveyors 13 and 14—and comprises two belt conveyors 34 located one over the other to convey reams 2 and respective sheets 4 of packing material folded into a U about reams 2. Belt conveyors 34 have respective belts 35 looped about pulleys 36; and respective parallel, facing work branches 37 spaced apart by a distance substantially equal to height H of reams 2.

Conveyor 15 comprises a drum 38 rotating about a horizontal axis 39 perpendicular to direction D1, and supporting two belt conveyors 40, each comprising a belt 41 looped about pulleys 42.

Belts 41 have respective projections 43 parallel to axis 39, are operated in time with each other, and define respective facing work branches 44 spaced apart by a distance substantially equal to height H of ream 2.

Conveyor 16 comprises two belt conveyors 45 located one over the other and having respective belts 46 looped about pulleys 47, and respective parallel, facing work branches 48 spaced apart by a distance substantially equal to height H of reams 2. A drum 49 is located at the output of the bottom belt conveyor 45, rotates about an axis 50 parallel to axis 39, has a heating body 51 along its outer surface, and is located between belt conveyor 45 and conveyor 17, which removes packs 5.

With reference to FIG. 1, unwinding device 18 comprises two vertical pins 52 (only one shown in FIG. 1) supporting respective reels 20 of strips 19; two drive rollers 53; and rollers 54 for guiding the strips 19 unwound off respective reels 20 along respective unwinding paths converging towards rollers 53. Strips 19 are unwound alternately off respective reels 20 to change over from one reel 20 to the other. That is, as one strip 19 is unwound off one reel 20, the other reel 20 can be taken off the idle pin 52 and replaced with a new reel 20.

Cut-off device 21 is adjacent to rollers 53 and comprises a fixed blade 55 located along the path of strip 19; and a vertical-axis drum 56 having a blade 57 located along the periphery of drum 56 and rotated in time with strip 19 to cooperate with blade 55 and cut a sheet 4 of packing material off strip 19.

Conveying device 22 for conveying sheet 4 of packing material is adjacent to cut-off device 21, and comprises four belt conveyors 58 divided into two pairs 59 of conveyors 58, located one over and the other beneath ream feed unit 10 and conveyors 13 and 14, to grip sheet 4 or strip 19 at opposite ends. Each pair 59 of conveyors 58 has two adjacent work branches 60 for gripping and simultaneously feeding forward a sheet 4 of packing material or strip 19. That is, conveyors 58 feed strip 19 forward and support the free end of strip 19 until sheet 4 is cut off strip 19. Conveying device 22 also comprises a guide 61 comprising two parallel, facing plates 62 and 63 spaced a small distance apart to form a gap, which is engaged by sheet 4 of packing material or by strip 19 until sheet 4 is cut off strip 19. An opening 64, of a length substantially equal to height H of reams 2, is formed in plates 62 and 63 at conveyors 13 and 14; plate 62 is connected to a further two plates 65 and 66 parallel to work branch 28; plate 65 is comb-shaped and inserted between the belts of conveyor 26; and plate 66 is located over plate 65 and separated from plate 65 by a distance substantially equal to height H of reams 2.

Plate 63 has two free edges 67 defining the top and bottom of opening 64 and, in fact, a folding spindle for folding sheet 4 about ream 2, so that device 22 for conveying sheets 4 of packing material defines one of the folding members referred to previously. The folding members also comprise two fixed folding devices 68 located along path P at conveyor 14; a plate 69 between conveyors 15 and 16; and three pairs of fixed folding devices 70, 71, 72 located successively along path P at conveyor 16. Feed unit 10 for feeding reams 2 and packs 5 comprises reinforcing plates 73 extending along, and for preventing deformation of, respective work branches 25, 37, 48 of conveyors 12, 14, 16; and bars 74 located at the crossover points between conveyors 14 and 15 and conveyors 15 and 16. Bars 74 provide for filling the gaps formed by the curve of pulleys 36, 42, 47 at the crossover points between conveyors 14, 15, 16, and also act partly as folding members. That is, each gap is filled by two adjacent bars 74, each integral with one of two adjacent conveyors 14, 15 and 15, 16, so that bars 74 fold sheet 4 of packing material as ream 2 and sheet 4 of packing material are turned over by conveyor 15. That is, bars 74 act as folding members upon relative displacement, crosswise to direction D1, of adjacent conveyors 14, 15, 16.

Machine 1 also comprises two gumming devices 75 located along conveyor 16 to apply two bands S of adhesive to sheets 4 of packing material.

With reference to FIG. 2, in actual use, a ream 2 is fed by conveyor 12 along path P, rests on work branch 25 of conveyor 12 along a base face 6 hereinafter referred to as the supporting base face 6, and is positioned with lateral faces 7 perpendicular to feed direction D1. End faces 8 are therefore positioned parallel to feed direction D1, and the base face 6 opposite the supporting base face 6 is hereinafter referred to as the top base face 6.

In the accompanying drawings, reams 2 are fed from left to right, so the two lateral faces 7 of each ream 2 located to the left and right in feed direction D1 in the accompanying drawings are hereinafter referred to as the upstream and downstream lateral face 7 respectively. Conveyor 12 transfers ream 2 to conveyor 13, which feeds ream 2, resting on work branch 28 of belt conveyor 26, in direction P, while laterally engaging end faces 8 by means of work branches 32 of belt conveyors 29, and at the same time positioning projections 33 in contact with lateral faces 7 to prevent any disarrangement of ream 2 in direction D1. Conveying device 22 feeds a sheet 4 of packing material along guide 61 into the position shown in FIG. 6 with respect to ream 2. Sheet 4 of packing material has a band A of adhesive, which is inactive and which is activated by heat when the package is completed.

Figure 3:
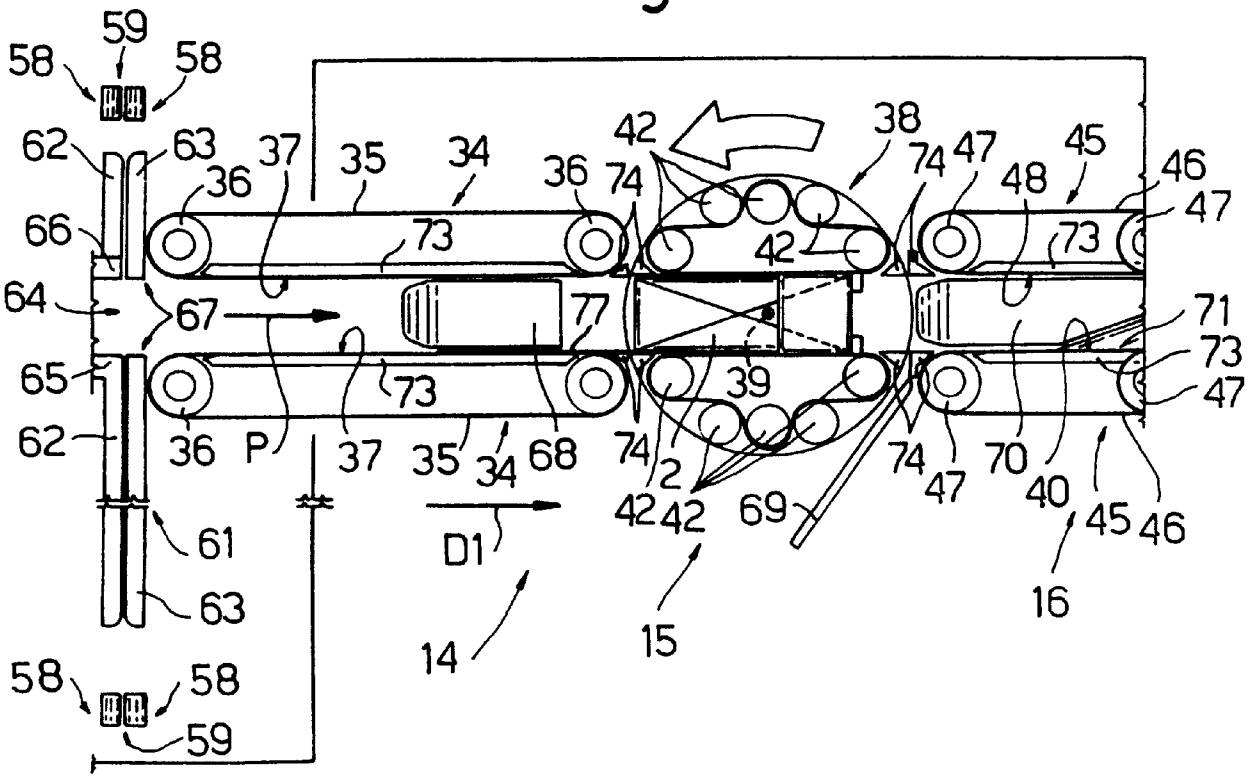
FIG. 3 shows a larger-scale side view, with parts removed for clarity, of a portion of the FIG. 2 machine in the course of a second step in the method according to the present invention.
Figure 7:
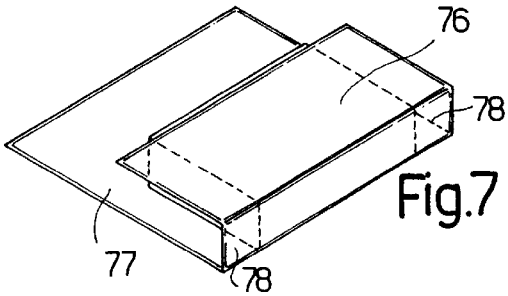
Figure 8:
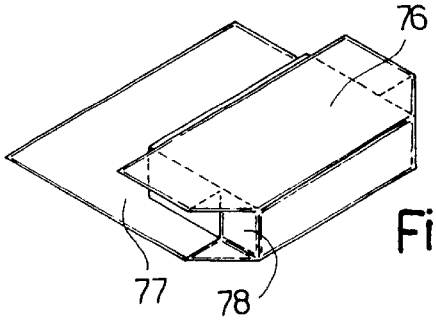

Conveyor 13 then pushes ream 2—partly by means of belt conveyor 26 and partly by means of projections 33 on belt conveyors 29 pushing the upstream lateral face 7—through opening 64 to engage sheet 4 of packing material, which is folded into a U by the free edges 67 of plate 63, i.e. by the folding spindle indicated by the same reference number 67 as the edges of plate 63. At this stage, in which the force exerted by sheet 4 of packing material on the downstream lateral face 7 could disarrange the sheets 3 in ream 2, ream 2 is retained by belts 30 and projections 33. With reference to FIG. 7, the U-folded sheet 4 of packing material adheres to the downstream face 7 in direction D1, and has a portion 76 having a free portion on the top base face 6, and a portion 77 partly contacting the supporting base face 6 and partly projecting with respect to the upstream lateral face 7. Sheet 4 of packing material also has two tabs 78 projecting with respect to the downstream lateral face 7, and which are folded on to end faces 8 (FIG. 8) by folding devices 68 located at conveyor 14 (FIGS. 2 and 3). Conveyor 14 keeps portions 76 and 77 in contact with base faces 6 by means of belts 35 along work branches 37 of belt conveyors 34, and transfers ream 2 and sheet 4 of packing material to conveyor 15 between the two conveyors 40 aligned with conveyors 32. That is, ream 2 and the U-folded sheet 4 of packing material are gripped between the two belt conveyors 34 to hold sheet 4 of packing material in position and increase friction between sheets 3 in ream 2.

Figure 4:
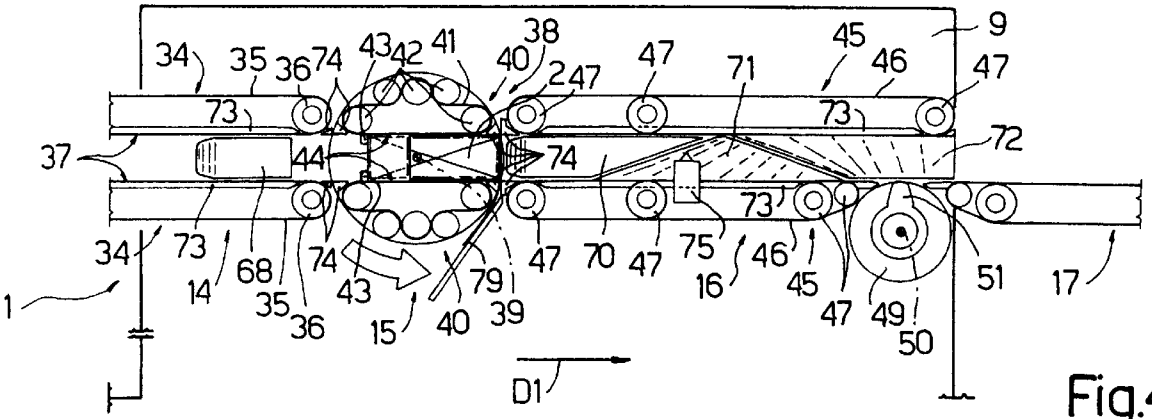
FIGS. 4 and 5 show side views, with parts removed for clarity, of portions of the FIG. 2 machine in the course of further steps in the method according to the present invention.
Figure 5:
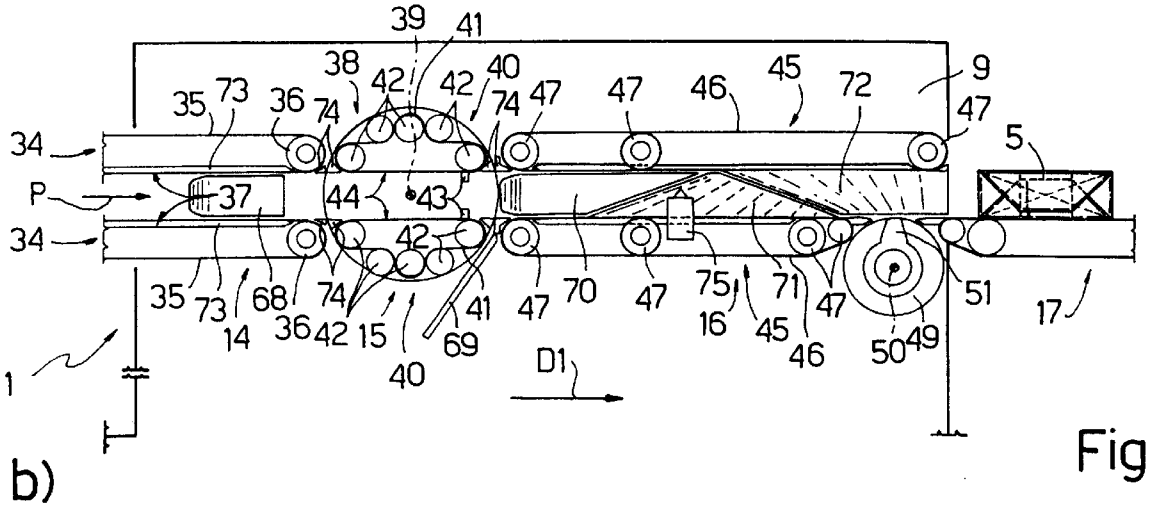
Figure 9:
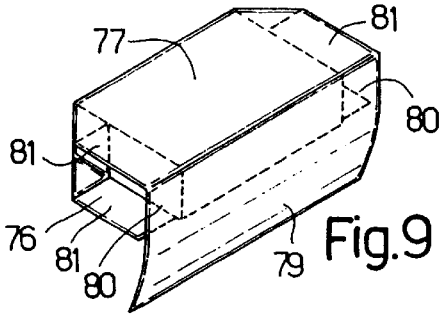

On conveyor 15, ream 2 and sheet 4 of packing material are gripped between belts 41 along respective work branches 44, and rest against projections 43 which are fed forward together with respective belts 41 to position the edges of the upstream lateral face 7 substantially flush with the outer surface of drum 38 (FIG. 3) and bars 74 associated with conveyor 15. Drum 38 is rotated 180° anticlockwise, in FIGS. 3 and 4, about axis 39 to align conveyors 40 with conveyors 34 and 45 and so invert the position of base faces 6 and lateral faces 7 and, at the same time, fold sheet 4 of packing material as shown in FIG. 9. That is, following rotation of the drum, the base face 6 resting on conveyors 12, 13 and 14 becomes the top base face 6, and the upstream lateral face 7 on conveyors 12, 13 and 14 is positioned downstream, and vice versa.

Portion 77 is folded on to lateral face 7 (upstream before rotation, and downstream after rotation, of the drum). With reference to FIG. 3, as the drum starts rotating, the bottom bar 74 associated with conveyor 14 makes a fold at the edge formed by the supporting base face 6 and the upstream lateral face 7; and, with reference to FIG. 4, as the drum completes its rotation, said fold is gone over again by folding device 69 and the bottom bar 74 associated with conveyor 16.

Figure 10:
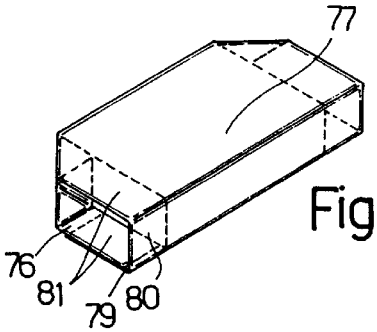
Figure 11:
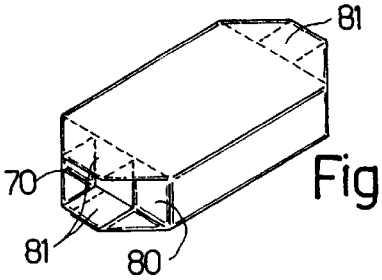
Figure 12:
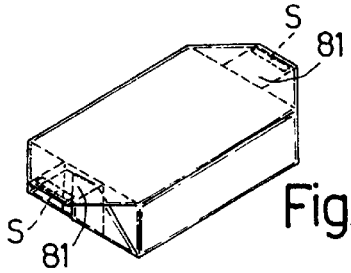

The bottom bar 74 associated with conveyor 16 provides for ironing portion 77 so that it adheres partly to the downstream lateral face 7 (as the drum completes its rotation). With reference to FIG. 9, the sheet folded partly about ream 2 has a portion 79 projecting downwards; two lateral tabs 80 projecting on opposite sides with respect to end faces 8 at the downstream lateral face 7; and two pairs of tabs 81 projecting with respect to end faces 8 at respective base faces 6. As ream 2 and sheet 4 of packing material are transferred from conveyor 15 to conveyor 16, the bottom bar 74 associated with conveyor 16 folds portion 79 on to the supporting base face 6 of ream 2 and on to portion 76 (FIG. 10), while the fixed folding devices 70 fold tabs 80 squarely on to end faces 8 and again go over tabs 78 on end faces 8 (FIG. 11). Ream 2 and sheet 4 of packing material are then fed past fixed folding device 71, which a helical folding device for folding the two bottom tabs 81 squarely on to end faces 8 (FIG. 12), while gumming devices 75 apply respective bands S of adhesive to the two top tabs 81, which are folded on to end faces 8 and bottom tabs 81 and sealed to bottom tabs 81 by bands S of adhesive to form the FIG. 13 pack 5, which is removed by conveyor 17. As pack 5 is transferred from conveyor 16 to conveyor 17, roller 49 is brought into contact with pack 5 and brings heating body 51 into contact with portion 79, at the portion of sheet 4 of packing material bearing strip A of adhesive, to activate the adhesive and seal portion 79 to portion 76.

What is claimed is:

1. A method of packing reams of sheets, wherein each ream is defined by sheets stacked to form a rectangular-base prism of a given height, and comprises two base faces defined by respective end sheets in said ream, two lateral faces perpendicular to the base faces, and two end faces; the method comprising feeding said ream along a given path by means of a feed unit, comprising a first conveyor pushing said ream in a feed direction parallel to said base faces, placing a sheet of packing material along the path of the ream by means of a supply unit for supplying sheets of packing material, placing said sheet of packing material crosswise to said feed direction, conveying the ream and the sheet of packing material through a folding spindle to form a U-shaped fold; conveying said ream and said partly folded sheet of packing material by means of adjacent second, third and fourth conveyors, wherein said third conveyor is located between said second and fourth conveyors and includes two belt conveyors to grip the ream and the sheet of packing material between said belt conveyors, and turning over said third conveyor (15), together with the ream and the partly folded sheet of packing material, about an axis perpendicular to said feed direction to fold a portion of the sheet of packing material into an L.

2. A method as claimed in claim 1, characterized by placing said sheet of packing material parallel to said lateral faces of the ream.

3. A method as claimed in claim 2, characterized by feeding said ream and said sheet of packing material through said spindle by means of first push members of said feed unit, which act on the lateral face located upstream with respect to the feed direction.

4. A method as claimed in claim 3, characterized by feeding said ream and the sheet of packing material through said spindle by means of the first conveyor forming part of said feed unit and comprising two belt conveyors having respective belts contacting the end faces along respective work branches.

5. A method as claimed in claim 4, characterized by gripping the ream and the partly folded sheet of packing material between opposite parallel further belts of each of the second, third and fourth conveyors.

6. A method as claimed in claim 1, characterized in that said axis is perpendicular to the end faces.

7. A method as claimed in claim 1, characterized by turning said ream and the respective sheet of packing material over through 180° about said axis to invert the position of the base faces and of the lateral faces with respect to the feed direction.

8. A method as claimed in claim 1, characterized in that said second, third and fourth conveyors comprise bars located at the crossover points between said second, third and fourth conveyors; the method providing for positioning the upstream lateral face flush with the bars associated with the third conveyor.

9. A method as claimed in claim 1, characterized by folding said sheet of packing material about said ream to form a tubular package about the base faces and the lateral faces; and folding tabs, projecting with respect to the end faces, squarely on to the end faces solely by means of fixed folding devices located along the path of the ream.

10. A machine for packing reams of sheets, wherein each ream is defined by sheets stacked to form a rectangular-base prism of a given height, and comprises two base faces defined by respective end sheets in said ream, two lateral faces perpendicular to the base faces, and two end faces; the machine comprising a feed unit for feeding said ream along a given path, a supply unit for supplying sheets of packing material and for placing a sheet of packing material along the path of the ream, a folding spindle located along the path to fold the sheet of packing material into a U about said ream; wherein said feed unit comprises a first conveyor for pushing said ream, at said folding spindle, in a feed direction parallel to said base faces; wherein said supply unit comprises a conveying device for keeping said sheet of packing material crosswise to the feed direction at said folding spindle, wherein said feed unit comprises adjacent second, third and fourth conveyors for feeding said ream and said partly folded sheet of packing material along said path in said feed direction; wherein said third conveyor has a drum supporting two belt conveyors parallel to and facing each other to grip the ream and the sheet of packing material; said drum rotating about an axis perpendicular to said feed direction to fold a portion of the U-folded sheet of packing material into an L about the ream by means of fixed folding members.

11. A machine as claimed in claim 10, characterized in that said first conveyor comprises push members acting on the lateral face upstream with respect to the feed direction of the ream; said conveying device keeping said sheet of packing material parallel to and facing the downstream lateral face.

12. A machine as claimed in claim 11, characterized in that said conveying device comprises a guide comprising a first and a second plate having an opening permitting passage of said ream; said folding spindle being defined by the free edges of said second plate at said opening.

13. A machine as claimed in claim 11, characterized in that said first conveyor comprises two belt conveyors having respective belts extending along respective work branches and which contact the end faces of the ream.

14. A machine as claimed in claim 13, characterized in that said push members are projections located along said belts.

15. A machine as claimed in claim 10, wherein each of the second, third and fourth conveyors comprise two further conveying devices parallel to and facing each other to grip the ream and the partly folded sheet of packing material.

16. A machine as claimed in claim 15, characterized in that said further conveying devices are belt conveyors.

17. A machine as claimed in claim 10, which includes folding members located along the path, at said second, third and fourth conveyors, to fold the sheet of packing material about said ream.

18. A machine as claimed in claim 10, characterized in that the drum rotates through 180° about said axis to invert the position of the base faces and of the lateral faces with respect to the feed direction.

19. A machine as claimed in claim 10, characterized in that said second conveyor is located directly upstream from said third conveyor, and said fourth conveyor is located directly downstream from said third conveyor; the feed unit comprising bars extending transversely with respect to the feed direction, associated with each of said second, third and fourth conveyors, and located at the crossover points between said second, third and fourth conveyors to fold a further portion of said sheet of packing material into an L as said belt conveyors are rotated.

20. A method of packing products comprising feeding at least one product along a given path and in a given direction by means of a feed unit, comprising a first conveyor placing a sheet of packing material along said path by means of a supply unit for supplying sheets of packing material, placing said sheet of packing material crosswise to said feed direction, conveying the product and the sheet of packing material through a folding spindle to form a U-shaped fold; conveying said product and said partly folded sheet of packing material by means of adjacent second, third and fourth conveyors, wherein said conveyors comprise a third conveyor is located between said second and fourth conveyors and includes two belt conveyors to grip the product and the sheet of packing material between said belt conveyors, and turning over said third conveyor, together with the product and the partly folded sheet of packing material, about an axis perpendicular to said feed direction to fold a portion of the sheet of packing material into an L.

21. A machine for packing products comprising a feed unit for feeding at least one product along a given path, a supply unit for supplying sheets of packing material and for placing a sheet of packing material along the path of the product, a folding spindle located along the path to fold the sheet of packing material into a U about said product, wherein said feed unit comprises a first conveyor for pushing said product, at said folding spindle, in a feed direction parallel to said base faces; wherein said supply unit comprises a conveying device for keeping said sheet of packing material crosswise to the feed direction at said folding spindle, wherein said feed unit comprises adjacent second, third and fourth conveyors for feeding said product and said partly folded sheet of packing material along said path in said feed direction; wherein said third conveyor has a drum supporting two belt conveyors parallel to and facing each other to grip the product and the sheet of packing material; said drum rotating about an axis perpendicular to said feed direction to fold a portion of the U-folded sheet of packing material into an L about the product by means of fixed folding members.

* * * * *